United States Patent [19]

Wheeler

[11] 4,446,765

[45] May 8, 1984

[54] TORQUE TRANSMITTING DEVICE

[76] Inventor: Daryl Wheeler, 4 Hope Rd., Ardross, Australia, 6153

[21] Appl. No.: 387,878

[22] PCT Filed: Oct. 2, 1981

[86] PCT No.: PCT/AU81/00142

§ 371 Date: Jun. 4, 1982

§ 102(e) Date: Jun. 4, 1982

[87] PCT Pub. No.: WO82/01150

PCT Pub. Date: Apr. 15, 1982

[51] Int. Cl.[3] ..... B25B 15/00

[52] U.S. Cl. ..... 81/441

[58] Field of Search ..... 81/441, 436

[56] References Cited

U.S. PATENT DOCUMENTS 1,366,647 1/1921 Gooding .
1,554,287 9/1925 McGuckin .
1,754,736 4/1930 Bryant .
1,813,567 7/1931 Delorme ..... 81/441
2,781,683 2/1957 Weeks .

FOREIGN PATENT DOCUMENTS 957489 11/1974 Canada .
1070991 2/1980 Canada .

*Primary Examiner*—Frederick R. Schmidt
*Assistant Examiner*—J. T. Zatarga
*Attorney, Agent, or Firm*—Holman & Stern

[57] ABSTRACT

A torque transmitting device characterized by a shaft (14) having a horizontal axis (17) and a first end and a second end said first end being arranged to be inserted foremost into a bore in a workpiece, wherein the shaft (14) is formed with at least one groove (16) extending longitudinally of the shaft (14), a workpiece engaging jaw (19) is mounted in the or each groove (16), means (13) is provided for retaining the or each jaw (19) in its respective groove (16) and wherein the or each groove (16) is tilted with respect to the longitudinal axis (17) of the shaft (14) so that the or each jaw is non-aligned with the longitudinal axis (17) of the shaft (14).

16 Claims, 6 Drawing Figures

TORQUE TRANSMITTING DEVICE

The invention of this application is disclosed in corresponding International Application No. PCT/AU 81/00142 filed Oct. 2, 1981.

DESCRIPTION

The present invention relates to a torque transmitting device.

The torque transmitting device of the present invention is particularly adapted to be impulse driven into an internal bore in a workpiece.

SUMMARY OF THE INVENTION

In accordance with the present invention there is provided a torque transmitting device comprising a shaft having a longitudinal axis, wherein the shaft is formed with at least one groove extending longitudinally of the shaft, a workpiece engaging jaw is mounted in the or each groove, means is provided for retaining the or each jaw in its respective groove, and wherein the or each groove is tilted with respect to the axis of the shaft so that the or each jaw is non-aligned with the longitudinal axis of the shaft.

BRIEF DESCRIPTION OF THE DRAWINGS

The present invention will now be described, by way of example, with reference to the accompanying drawings, in which.

DESCRIPTION OF THE INVENTION

Figure 1:
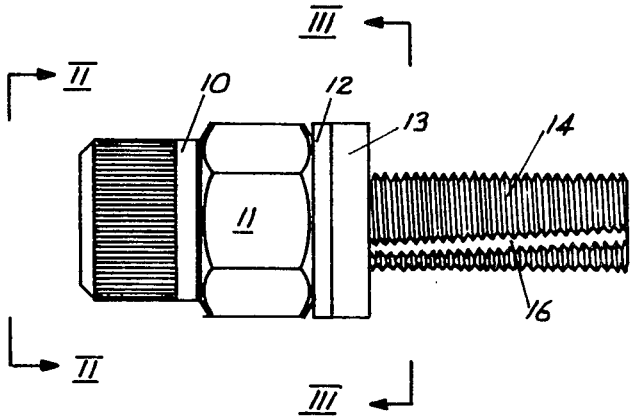
FIG. 1 is a side elevation of a torque transmitting device of the present invention.

FIGS. 1 to 3 and FIG. 4 show respectively two different embodiments of the present invention as will be described hereinafter. For convenience like reference numerals will be used to denote like parts in the two embodiments.

Figure 2:
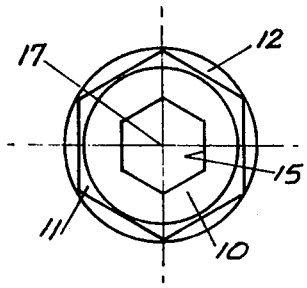
FIG. 2 is an end elevation of the device of FIG. 1 along the line II—II of FIG. 1.
Figure 3:
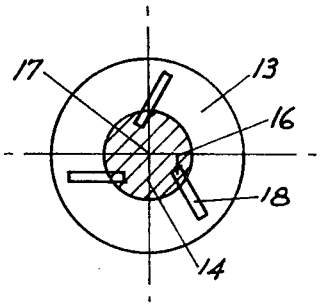
FIG. 3 is a sectional view of the device of FIG. 1 along the line III—III of FIG. 1.

In FIGS. 1 to 3, there is shown a torque transmitting device adapted to be impulse driven into an internal bore in a workpiece. The workpiece can take many forms. For example, it may be a tube in threaded engagement with a matching component, a threaded shaft, a stud, or a sheared bolt having no external means of torque connection and having a hole therein to receive the device of the present invention.

The device of FIGS. 1 to 3 comprises a head 10, a hexagonal nut 11, a metal washer 12 and a slotted annular collar 13.

The head 10 is integrally formed with an externally threaded shaft 14. Further, the head 10 contains a hexagonal recess 15 arranged to receive an Allen key. The nut 11 is threadedly mounted on the shaft 14 and is located adjacent the head 10. The washer 12 is located between the nut 11 and the annular collar 13. The washer 12 and annular collar 13 are not threadedly engaged on the shaft 14 but are mounted thereabout in a snug fitting relationship.

The shaft 14 contains three longitudinally extending grooves 16. Each groove 16 extends from the end of the shaft 14 remote from the head 10 to a point spaced from but adjacent to the head 10.

As can best be seen in FIG. 3 each groove 16 is tilted so as to be non-aligned with longitudinal axis 17 of the shaft 14. Each groove 16 is tilted towards the direction of rotation of the shaft 14 upon removal of a workpiece.

The tilting means that jaws 19 which will be described hereinafter, take compression force rather than shear force thus reducing the possibility of shear and facilitating the use of thinner jaws 19. Preferably, the grooves 16 are tilted at an angle in the range from 4° to 40°; more preferably from 4° to 25°, with respect to a diametrical line extending from the centre of the outer end of a groove through the axis of the shaft 14. Further, each groove 16 slopes downwardly into the shaft 14 away from the annular collar 13. This can best be seen in FIG. 4 where the slope of the corresponding groove 16 of that embodiment of the present invention is clearly shown in phantom. Preferably, the inclined plane of the slope of the groove 16 is inclined at an angle in the range from 1.5° to 18°; more preferably from 1.5° to 8°, with respect to the outer surface of the shaft 14.

Still further, each groove 16 does not extend parallel to the axis of the shaft 14 but is angled across the face of the shaft 14. Each groove 16 is angled across the face of the shaft 14 so as to tend, as it moves away from the annular member 13, towards the direction of rotation on removal of a workpiece. Thus, the shaft 14 shown in FIG. 1 is arranged to be removed in a counter-clockwise direction looking from the head 10. For clockwise removal, the grooves 16 would be angled across the face of the shaft 14 in the opposite direction. By angling the grooves 16 across the face of the shaft 14, applied torque tends to cause the shaft 14 to spiral down jaws 19 as described hereinafter so expanding them. Preferably, the grooves 16 are angled across the face of the shaft 14 at an angle in the range from 1° to 18° to the axis of the shaft. However, whilst it is preferred for the grooves 16 to be straight cut for ease of manufacture, for angles above 10° it may be necessary for the grooves 16 to have a helical profile tending towards the direction of rotation when removing a workpiece. Most preferably, the grooves 16 are angled at an angle in the range from 1° to 6° across the face of the shaft 14. It should be emphasied that the grooves 16 can be straight or helical right through the range of preferred angles mentioned above.

As can be seen in FIG. 3, the annular collar 13 comprises three slots 18 aligned with the grooves 16 of the shaft 14. The slots 18 are arranged to receive the radially outwardly extending projections of jaws 19. This enables the jaws 19 to be retained in place on the shaft 14 when in storage. Further, the slots 18 extend right through the annular collar 13 so that, in use, the jaws 19 may be in abutting relation with the washer 12.

Figure 5:
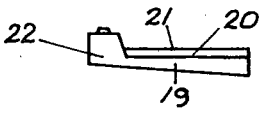
FIG. 5 is a side elevation of a workpiece engaging jaw for use with the devices of FIGS. 1 to 4.
Figure 6:
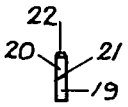
FIG. 6 is an end elevation of the workpiece engaging jaw of FIG. 5.

Each groove 16 is arranged to contain a jaw 19 as shown in FIGS. 5 and 6. Each jaw 19 comprises an elongated workpiece engaging blade 20 which has a quadrilateral shape in cross section. Further, the upper face (as shown in FIGS. 5 and 6) of each blade 20 is angled to provide a cutting edge 21 for engaging a workpiece. Each cutting edge 21 is arranged to be the leading edge of the upper face of its blade 20 upon rotation to withdraw a workpiece. Further, each jaw 19 comprises a radially outwardly extending projection 22.

In use, the jaws 19 are moved down the shaft 14 to an extent sufficient for them to enter a concentric internal bore in a workpiece. The shaft 14 is then inserted into the bore until the radially outwardly extending projections 22 of the jaws 19 engage the entrance to the bore. Then the shaft 14 is impulse driven into the bore. This causes the jaws 19 to move rearwardly up the shaft 14 and, because of the slope of the grooves 16, the jaws 19 simultaneously expand outwardly into engagement with the sides of the bore.

The angling of the grooves 16 causes the shaft 14, when torque is applied to it, to be driven down and around causing proportional expansion of the blades 20 with relation to applied torque. The use of impulse drive has the advantage that higher forces can be applied for short periods of time. Also, impulse drives are typically arranged to apply a small amount of twist on each impulse which drives the shaft 14 down and around as described above so ensuring good engagement with the interior of the bore.

Further, as the jaws 19 are tilted in the grooves 16, the blades 20 tend to draw the workpiece in so assisting in release of the workpiece. Still further, the jaws 19 are so shaped that the upper surfaces (as seen in the drawings) of the blades 20 move parallel to the shaft 14 and the bore when the jaws 19 move rearwardly.

When the blades 20 are in engagement with the side of the bore the workpiece can then be removed by turning the head 10 so as to move the shaft 14 in the clockwise direction as seen in FIG. 3. This causes the cutting edges 21 of the blades 20 to bite into the workpiece since the cutting edges of the blades 20 are foremost in the turning action. The grooves 16 are tilted as described above and so the turning force tends to act into the body of the shaft 14 and not at right angles to it. This reduces the possibility of the blades 20 being sheared in use. Further, when initially removing the shaft 24, the blades 20 can cut in and tend to become loose. The angling of the grooves 16 across the surface of the shaft 14 has a spiral effect and causes the shaft 14 to move inwardly of the bore to take up any such slack.

Figure 4:
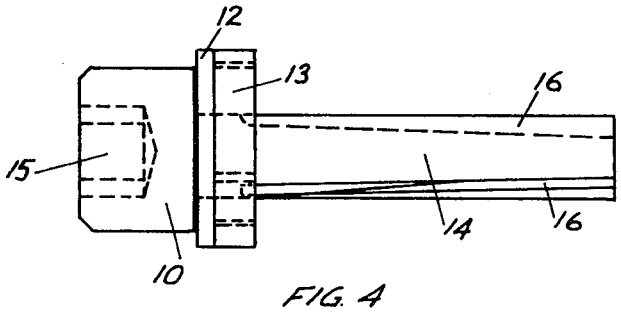
FIG. 4 is a side elevation of a torque transmitting device similar to that shown in FIG. 1 with certain internal features indicated in phantom.

The nut 11 is not essential and as shown in FIG. 4 can be omitted altogether. However, it can be moved along the shaft 14 away from the head 10 to limit the amount of possible expansion of the jaws 19. Also, after use, it can be moved down the shaft 14 to push the jaws 19 away from the head 10 to release the jaws 19 from the removed workpiece.

The shaft 14 in the embodiment of FIGS. 1 to 3 need only be threaded in the region of the nut 11. The shaft 14 shown in FIG. 1 is threaded along its entire length but this is for convenience of manufacture only. The shaft 14 shown in FIG. 4 is not threaded at all.

Modifications and variations such as would be apparent to a skilled artisan are deemed within the scope of the present invention.

I claim

1. A torque transmitting device characterised by a shaft having a longitudinal axis and a first end and a second end said first end being arranged to be inserted foremost into a bore in a workpiece, wherein the shaft is formed with at least one groove extending longitudinally of the shaft, a workpiece engaging jaw is mounted in the or each groove, means is provided for retaining the or each jaw in its respective groove and wherein the or each groove is tilted with respect to the longitudinal axis of the shaft so that the or each jaw is non-aligned with the longitudinal axis of the shaft.

2. A torque transmitting device according to claim 1, characterised in that the or each groove is progressively increasing depth towards the first end of the shaft.

3. A torque transmitting device according to claim 1 or 2, characterised in that the or each groove is not aligned parallel to the longitudinal axis of the shaft but is angled across the face of the shaft so as to tend, towards the first end of the shaft, towards the direction of rotation of the shaft upon removal of a workpiece.

4. A torque transmitting device according to claims 1 or 2, characterised in that it comprises a head at the second end of the shaft which head is arranged to be engaged by a tool for rotating the device to remove a workpiece.

5. A torque transmitting device according to claims 1 or 2, characterised in that the means for retaining the or each jaw in its respective groove is an annular collar mounted about the shaft in snug fitting relation.

6. A torque transmitting device according to claim 5, characterised in that the or each jaw comprises a radially outwardly extending portion which portion is arranged to be engaged in corresponding slots in the annular collar.

7. A torque transmitting device according to claims 1 or 2, characterised in that the or each jaw comprises a cutting blade provided with a cutting edge which leads upon rotation of the shaft to remove a workpiece.

8. A torque transmitting device according to claims 1 or 2, characterised in that it comprises at least three of the grooves disposed equi-angularly about the shaft.

9. A torque transmitting device according to claims 1 or 2, characterised in that it is capable of being impulse driven into a bore in a workpiece.

10. A torque transmitting device according to claim 1, characterised in that the or each groove is tilted at an angle in the range from 4° to 40°.

11. A torque transmitting device according to claim 10, characterised in that the or each groove is tilted at an angle in the range from 4° to 25°.

12. A torque transmitting device according to claim 2, characterised in that the or each groove slopes into the shaft at an angle in the range from 1.5° to 18°.

13. A torque transmitting device according to claim 12, characterised in that the or each groove slopes into the shaft at an angle in the range from 1.5° to 8°.

14. A torque transmitting device according to claim 3, characterised in that the or each groove is angled across the face of the shaft at an angle in the range from 1° to 18°.

15. A torque transmitting device according to claim 14, characterised in that the or each groove is angled across the face of the shaft at an angle in the range from 1° to 10°.

16. A torque transmitting device according to claim 15, characterised in that the or each groove is angled across the face of the shaft at an angle in the range from 1° to 6°.

* * * * *